United States Patent [19]

van Ham

[11] 4,043,238

[45] Aug. 23, 1977

[54] CABLE CUTTER

[75] Inventor: Ernest E. van Ham, Lyndeboro, N.H.

[73] Assignee: Sanders Associates, Inc., Nashua, N.H.

[21] Appl. No.: 678,806

[22] Filed: Apr. 21, 1976

[51] Int. Cl.[2] ..... B26D 4/42

[52] U.S. Cl. ..... 83/595; 83/676; 83/680; 83/663

[58] Field of Search ..... 53/595, 596, 663, 676, 53/440, 440.1, 926 B, 673, 694, 675, 680

[56] References Cited

U.S. PATENT DOCUMENTS

| | | | |
|---|---|---|---|
| 28,068 | 5/1860 | Edwards et al. | 83/860 X |
| 1,143,285 | 6/1915 | Koella | 83/596 X |
| 1,957,623 | 5/1934 | Walter | 83/676 X |
| 3,776,080 | 12/1973 | Reifenhaeuser | 83/595 X |

*Primary Examiner*—Willie G. Abercrombie
*Attorney, Agent, or Firm*—Louis Etlinger

[57] ABSTRACT

A cutting implement having a plate with a curved, sharpened edge which is rotated to traverse the location of a work piece. The plate is shaped so that the rate of advance of the sharpened edge through the location decreases as the angle of rotation increases, thereby compensating for the gradual reduction in the mechanical advantage, and producing a nearly constant power requirement.

18 Claims, 4 Drawing Figures

CABLE CUTTER

FIELD OF THE INVENTION

This invention relates generally to a cutting implement and particularly to such an implement which is suitable for cutting completely through a work piece.

BACKGROUND OF THE INVENTION

When working in hostile environments, such as are encountered in space programs and in undersea operations, there is frequently a need for a cutting implement which can cut through various items such as ropes, cables, bolts, and the like. In such circumstances it is often impossible to use the more usual cutting implements, such as a manually operated knife or a bolt cutter. For such operations what is needed is an implement which is as simple in construction and which used as little power as possible. It is also desirable, although not always essential, that the implement be adapatable for operation from a remote location, and capable of reuse without refurbishment.

OBJECT OF THE INVENTION

It is a general object of the present invention to provide an improved cutting implement.

A more specific object of the invention is to provide a cutting implement which is simple in construction and which requires a small amount of power for operation.

SUMMARY OF THE INVENTION

Briefly stated, the invention utilizes a rotatable plate with a curved cutting edge shaped so that rotation of the plate causes the cutting edge to traverse a predetermined location so as to slice through any work piece at that location. This feature makes it necessary to provide but one kind of motion, rotation of the plate, and makes it unnecessary to provide for translation of the axis of rotation relative to the work piece. The plate is also shaped so that the cutting edge advances at a rate which decreases with the angle of rotation, thereby tending to equalize the torque requirements throughout the cutting operation.

More particularly, a specific embodiment of the invention comprises a cutting implement including a frame, the frame including means for defining a work support at a predetermined location at which a work piece to be cut is positioned during the cutting operation, a plate having a curved, sharpened edge and mounted on the frame for rotation about an axis, the plate being shaped and the axis being positioned relative to the predetermined work support so that as the plate is rotated the edge traverses the location, wherein the plate also is shaped so that the rate of advance of the edge through the location, as a function of the angle of rotation of the plate, decreases as the angle of rotation increases.

BRIEF DESCRIPTION OF THE DRAWING

For a clearer understanding of invention reference may be made to the following detailed description and the accompanying drawing in which.

DESCRIPTION OF PREFERRED EMBODIMENT

Figure 2:
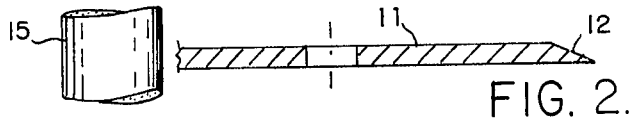
FIG. 2 is a cross sectional view taken on the line 2—2 of FIG. 1.
Figure 1:
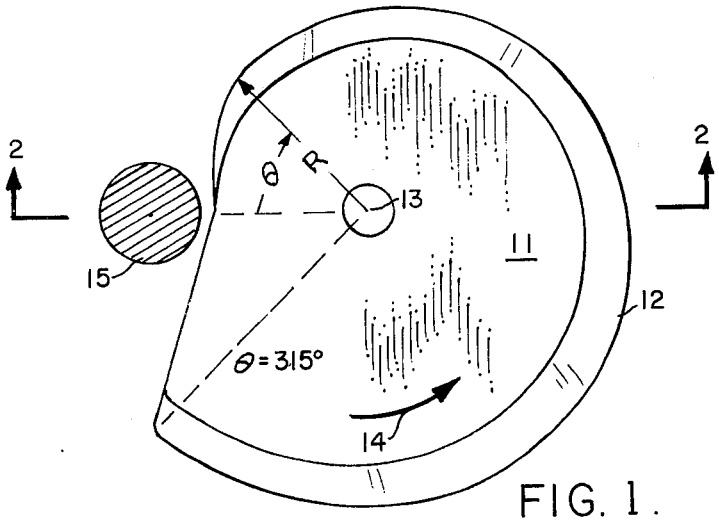
FIG. 1 is a schematic plan view of a cutter plate and its relation to a work piece to be cut.

Referring first to FIGS. 1 and 2, there is shown a plate 11 having a curved sharpened edge 12 which plate is rotatable about an axis 13. When rotated from the position shown in a counterclockwise direction as shown by the arrow 14, the edge 12 will traverse and slice through any work piece such as the work piece 15 held in the position shown in FIGS. 1 and 2.

In order to minimize the maximum amount of power required to rotate the plate 11, it is preferred to keep the torque requirements substantially constant. The torque required to rotate plate 11 is proportional to the product of the lever arm R, and the force resisting rotation, which force in turn is proportional to the rate of cutting, or, more accurately, is proportional to the incremental increase in R per degree of rotation. Expressed mathematically, $$T \alpha R \frac{dR}{d\theta} \qquad \text{Eq. 1}$$

In order to determine a proper contour for the curved edge 12, the expression of equation 1 is set equal to a constant and, upon integration, it is found that:

$$R = \sqrt{c\theta + k} \qquad \text{Eq. 2}$$

It is assumed that $\theta$ equals 0 when the plate is in the position shown in FIG. 1 from which it is determined that $k$ equals 1. For one specific embodiment of the invention, to be described in detail, it was desired that R equal 2.02 inches when $\theta$ equals 315°. From this condition it is learned that c equals 0.009779. Substituting these values in equation 2 it is found that:

$$R = \sqrt{0.009779\theta + 1} \qquad \text{Eq. 3}$$

Table I below shows several values of R, ΔR, and R × ΔR for various values of $\theta$.

Table 1

| $\theta$ Degrees | R | ΔR | R × ΔR |
|---|---|---|---|
| 0 | 1.000 | .20 | .20 |
| 45 | 1.20 | .17 | .20 |
| 90 | 1.37 | .15 | .21 |
| 135 | 1.52 | .14 | .21 |
| 180 | 1.66 | .13 | .22 |
| 225 | 1.79 | .12 | .21 |
| 270 | 1.91 | .11 | .21 |
| 315 | 2.02 | | |

In the preceding tabulation, ΔR is the incremental change in R for each incremental change in $\theta$. In other words, ΔR is an approximation to the expression $dR/d\theta$. It is noted that, for increasing values of $\theta$, the value of R increases as it must if it is to advance through the location of the work piece. It is also to be noted that ΔR decreases with increasing values of theta while the product R × ΔR remains substantially constant. This constancy of RΔR shows that, assuming that the length of the cut remains substantially constant with depth of cut (which is true to a first approximation when cutting rope), the torque required to rotate the plate 11 remains substantially constant.

Figure 4:
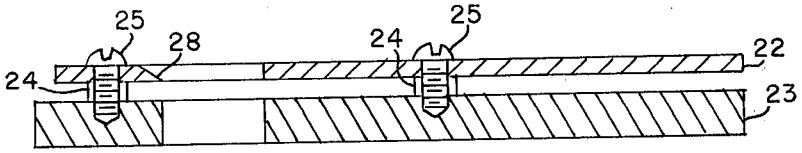
FIG. 4 is a cross sectional view taken on the line 4—4 of FIG. 3.
Figure 3:
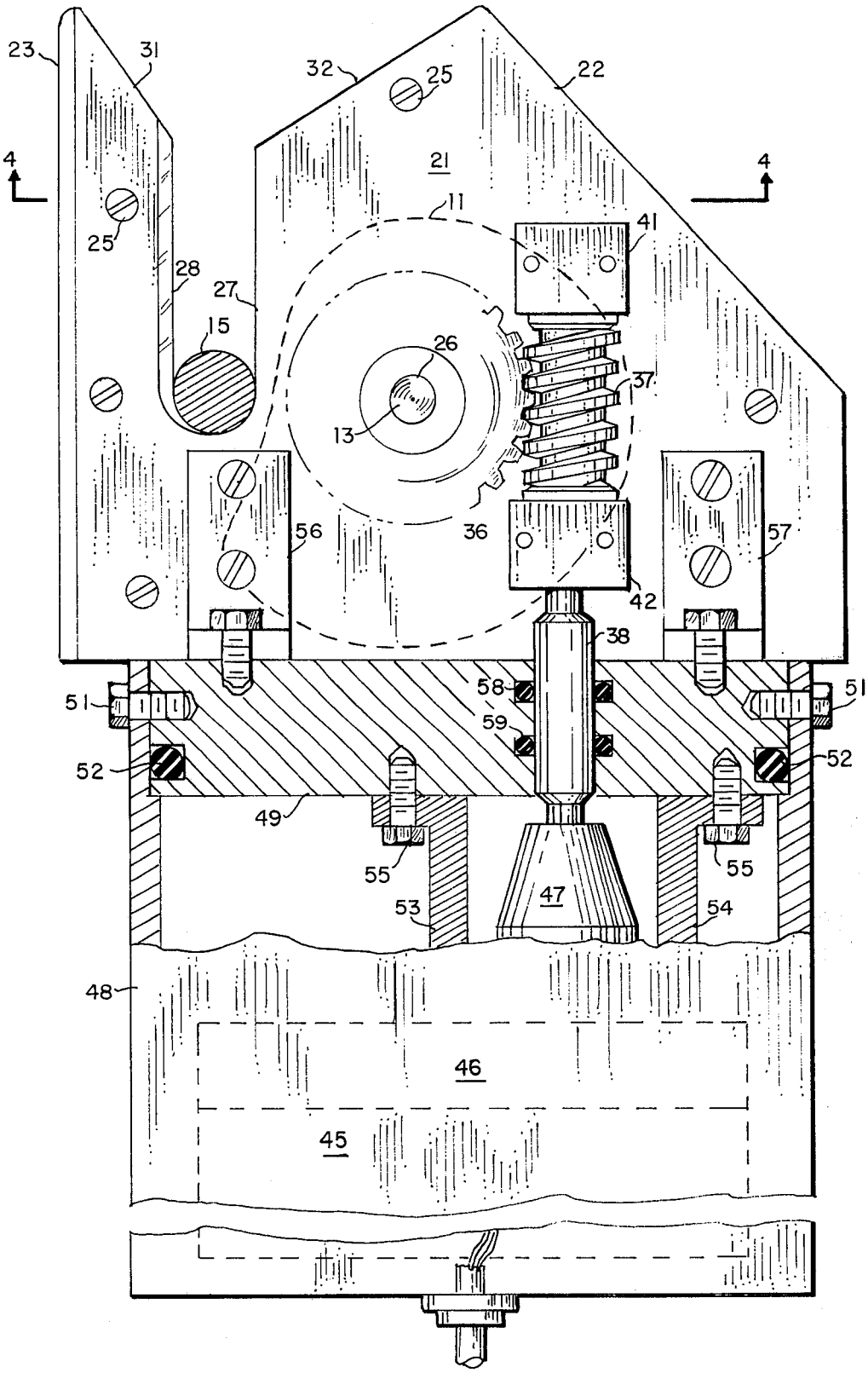
FIG. 3 is a schematic plan view, partly in section, partly in block, diagram of form, of a cutting implement in accordance with the invention.

Referring now to FIGS. 3 and 4, there is shown a specific embodiment of the invention employing the principles discussed above. A frame indicated generally by the reference character 21 includes two flat members 22 and 23 which are held in spaced apart relationship by a plurality of spacers such as the sleeves 24. A like plurality of screws 25 pass through the flat member 22 and the sleeves 24 and are threaded into the flat member 23. The previously mentioned plate 11 is positioned in the space between the members 22 and 23 and is fastened to a shaft 26 which is supported by and mounted for rotation in the flat members 22 and 23. The members 22 and 23 are formed to define a slot 27 which is closed at one end and open at the other end. The slot is located so that its closed end lies just to the left, as viewed in FIG. 3, of the plate II when this plate is in its reference or starting position as shown in FIGS. 1 and 3. The edges and the closed end of the slot 27 define a work support at a predetermined location at which any work piece, such as the work piece 15, is positioned during the cutting operation. That edge of the plate 22 which defines the edge of the slot 27 which is remote from the plate 11 is sharpened as shown at 28 to constitute a stationary cutting edge. The members 22 and 23 are formed so that the edges of the slot 27 at their open end, that is opposite the closed end, diverge as shown by the edges 31 and 32 so as to facilitate the entry of a work piece into the slot 27.

A spur gear 36 is fastened to the shaft of 26 at a point above the upper flat member 22. The gear 36 meshes with a worm 37 which in turn is fastened to a drive shaft 38. The shaft 38 is supported on either side of the worm 37 by means of bushings 41 and 42 which are fastened to the flat member 22 and which serve as both journal bearings and as thrust bearings.

The specific embodiment being described is suitable for use in undersea operations. An electric motor 45 (shown in dotted out line) is operatively connected to reduction gearing 46 (also shown in dotted out line) which in turn is operatively connected to a chuck 47. The motor 45, the gearing 46 and the chuck 47 are part of a unitary assembly and may, for example, constitute the parts of a commercially available electric drill. In any event, they are mounted within a generally cylindrical pressure vessel 48. More particularly, the open end of the pressure vessel is sealed by means of a bulkhead 49 fastened to the vessel 48 by any suitable means such as by the bolts 51 passing through the vessel and threaded into the bulkhead 49. The O-ring 52 provides a fluid seal. The assembly comprising the motor 45, the gearing 46 and the chuck 47 are fastened by means of a pair of brackets, 53 and 54 to the interior of the bulkhead 49 by means of bolts 55. The frame 21 is fastened to the exterior of the bulkhead by means of a pair of right angle brackets 56 and 57 which are bolted both to the frame member 22 and to the exterior of the bulkhead 49. The driveshaft 38 passes completely through the bulkhead and is clamped into the chuck 47. A pair of O-rings 58 and 59 surround the shaft 38 and fit into grooves in the bulkhead so as to provide a dynamic fluid-tight seal. Provision is made for static sealing of the power cable in the base of the pressure vessel.

In operation, the assembly comprising the pressure vessel of 48, the frame 21, and all the parts fastened thereto are manuvered so that the work piece to be cut enters the slot 27 and reaches the closed end which is the location at which it is to be positioned during the cutting operation. The motor 45 can then be energized whereupon the power will be transmitted through the gearing 46, the chuck 47, the drive shaft 38, the worm 37, the spur 36, and the shaft 26 to the plate 11 which will rotate. As it does, its edge 12 will traverse the closed end of the slot 27 and slice through any work piece which is positioned there. It is to be noted that as the plate 11 rotates its rate of advance as a function of the angle of rotation decreases as the angle of rotation increases. More particularly, as the plate advances, the product of the distance (R) from the axis 13 to the edge 12 of the plate where it is cutting and the rate of advance as a function of angle $(dR)/d\theta$ is substantially constant throughout the range of operation, that is, from zero to 315 degrees in this particular embodiment. This means that the torque required to rotate the plate 11 is substantially constant provided that the length of the actual cut is substantially constant. This is correct to a first approximation when cutting rope.

Although a preferred embodiment of the invention has been described in considerable detail for illustrative purposes, many modifications will occur to those skilled in the art. It is therefore desired that the protection afforded by Letters Patent be limited only by the true scope of the appended claims.

What is claimed is:

1. A cutting implement, comprising, a frame, said frame including means for defining a work support at a predetermined location at which a work piece to be cut is positioned during the cutting operation, a plate having a curved sharpened edge and mounted on said frame for rotation about an axis, said plate being shaped and said axis being positioned relative to said work support so that as said plate is rotated said edge traverses said location, characterized in that said plate also is shaped so that the rate of advance of said edge through said location as a function of the angle of rotation of said plate decreases as the angle of rotation increases.

2. A cutting implement in accordance with claim 1 in which said plate is shaped so that the product of the distance from said axis to said edge at said location and said rate of advance as a function of angle of rotation is substantially constant throughout the range of operation.

3. A cutting implement in accordance with claim 1 in which said plate is shaped so that $$R\frac{\Delta R}{\Delta\theta} = \tau, \text{ where}$$

R is the distance from said axis to said edge at said location;

$$\frac{\Delta R}{\Delta\theta}$$

is the rate of advance of said edge through said location as a function of the angle of rotation of said plate; and $\tau$ is a constant.

4. A cutting implement in accordance with claim 1 in which said frame includes two spaced apart flat members.

5. A cutting implement in accordance with claim 4 in which said plate is positioned between and mounted on said members for rotation, said axis being substantially perpendicular to said members.

6. A cutting implement in accordance with claim 5 in which said members are formed to define a slot extending completely therethrough and having an open end and a closed end, said closed end defining said predetermined location.

7. A cutting implement in accordance with claim 6 in which that edge of one of said members which defines the edge of said slot which is remote from said plate is sharpened to constitute a stationary cutting edge.

8. A cutting implement in accordance with claim 6 in which said flat members are so formed that the edges of said slot adjacent said open end diverge to facilitate entry of a work piece into said slot.

9. A cutting implement in accordance with claim 6 in which said plate is shaped so that in one angular position said plate is entirely outside of said slot and so that as said plate is rotated from said one position said sharpened edge of said plate traverses said slot adjacent to said closed end.

10. A cutting implement in accordance with claim 1 including means for rotating said plate.

11. A cutting implement in accordance with claim 10 in which said means for rotating includes a motor.

12. A cutting implement in accordance with claim 11 which includes a speed reducing mechanism operatively connected between said motor and said plate.

13. A cutting mechanism in accordance with claim 12 in which said speed reducing mechanism includes a gear mounted for rotation with said plate, worm engaging said plate and a drive shaft fastened to said worm and operatively connected to said motor.

14. A cutting implement in accordance with claim 13 which includes an additional speed reducing mechanism operatively connected between said motor and said drive shaft.

15. A cutting implement in accordance with claim 14 including a chuck operatively connected to be rotated by said additional speed reducing mechanism and in which said drive shaft is clamped in said chuck.

16. A cutting implement in accordance with claim 14 which includes a housing in which said motor and said auxiliary speed reducing mechanism are mounted.

17. A cutting implement in accordance with claim 16 in which said housing includes a bulkhead to which said frame is fastened and through which said drive shaft extends.

18. A cutting implement in accordance with claim 17 in which said housing is sealed to withstand a pressure differential between the inside and outside thereof and which includes a rotary seal within said bulkhead through which said drive shaft passes.

* * * * *